United States Patent [19]

Ré

[11] 3,958,827

[45] May 25, 1976

[54] RECLINING CHAIR

[75] Inventor: Frank M. Ré, Holyoke, Mass.

[73] Assignee: Dual Manufacturing and Engineering Incorporated, Holyoke, Mass.

[22] Filed: Jan. 9, 1975

[21] Appl. No.: 539,696

Related U.S. Application Data

[63] Continuation-in-part of Ser. No. 307,176, Nov. 16, 1972, abandoned.

[52] U.S. Cl. ..... 297/61; 297/85; 297/322

[51] Int. Cl.[2] ..... A47C 1/03

[58] Field of Search ..... 297/61, 75, 68, 83, 297/84, 85, 88, 330, 316, 317, 318, 329, 322, 354, 383; 5/47, 37; 248/393; 296/65 R

[56] References Cited

UNITED STATES PATENTS

| | | | |
|---|---|---|---|
| 755,090 | 3/1904 | Wersel, Jr. | 5/47 |
| 2,126,098 | 8/1938 | Ducrot | 297/318 |
| 2,725,921 | 12/1955 | Markin | 297/318 X |
| 2,815,794 | 12/1957 | Hendrickson et al. | 297/342 |
| 3,057,658 | 10/1962 | Winick | 297/317 X |
| 3,191,990 | 6/1965 | Rugg et al. | 297/316 X |
| 3,232,575 | 2/1966 | Ferro | 297/329 X |
| 3,343,871 | 9/1967 | Yates et al. | 297/330 |
| 3,427,072 | 2/1969 | Hale | 297/316 X |
| 3,652,125 | 3/1972 | Rogers | 297/61 |

FOREIGN PATENTS OR APPLICATIONS

| | | | |
|---|---|---|---|
| 720,801 | 5/1942 | Germany | 297/329 |

*Primary Examiner*—James T. McCall
*Attorney, Agent, or Firm*—Ross, Ross & Flavin

[57] ABSTRACT

A lowback reclining chair with a concealed headrest positionable in close adjacency to a room wall when in upright sitting position and yet so structured as to allow ready assumption of any of a variety of reclined positions of occupancy without physical contact of any element thereof with the same room wall, the chair envisioning a combination of kinematically related components comprising a base, a chassis movable relative to the base, and a body-support movable between sitting and reclining positions relative to the chassis with concurrent movements of a legrest and a headrest each between retracted and extended positions respectively, a main drive link connecting between the body-support and base for propelling the chassis relative to the base forwardly and progressively away from the wall as the body-support is moved from upright sitting position to progressive positions of reclination while the body support is concurrently moved rearwardly relative to the chassis but yet away from the room wall, and for propelling the chassis relative to the base rearwardly and progressively toward the wall as the body-support is moved from progressive positions of reclination to upright sitting position while the body support is concurrently moved forwardly relative to the chassis but yet toward the room wall.

5 Claims, 12 Drawing Figures

RECLINING CHAIR

This is a continuation-in-part of my copending application Ser. No. 307,176 filed Nov. 16, 1972 now abandoned.

The invention provides a reclining chair which can be positioned in close proximity to a wall or other article of furniture.

Herein, a chassis and body-support are moved progressively away from a wall concurrently with extension of a headrest and legrest as the chair assumes an intermediate position and fully reclined positions.

The linkage to be described herefollowing constitutes one of a pair, one being located at each side of the chair between the supporting chassis and the respective adjacent sides of the seat and backrest, it being understood that once the linkages are assembled with the other chair components they constitute, kinematically speaking, but a single mechanism.

Figure 1:
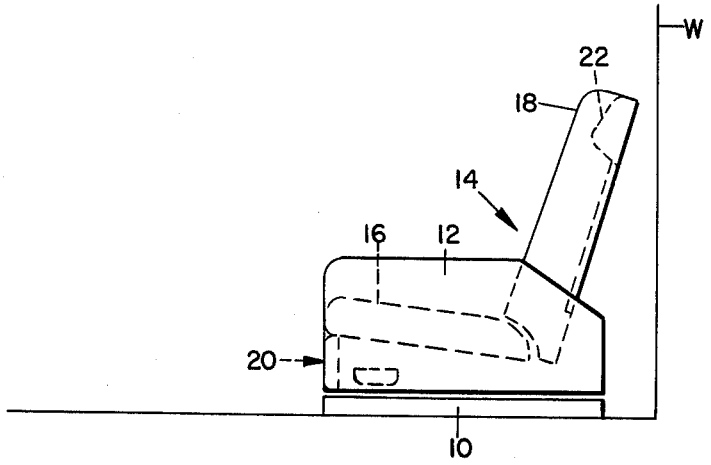
FIGS. 1 – 3 are schematic representations of a chair embodying the invention showing the positions of the several chair components relative to a wall as the chair is moved from an upright sitting position to a partially-reclined or TV position and then to a fully-reclined position.
Figure 2:
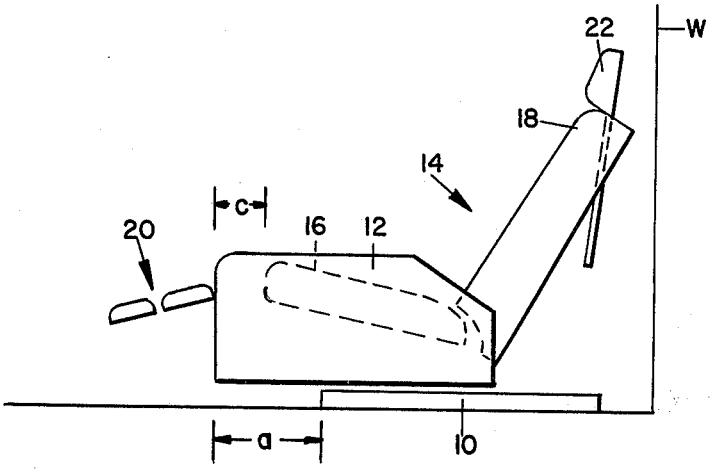
Figure 3:
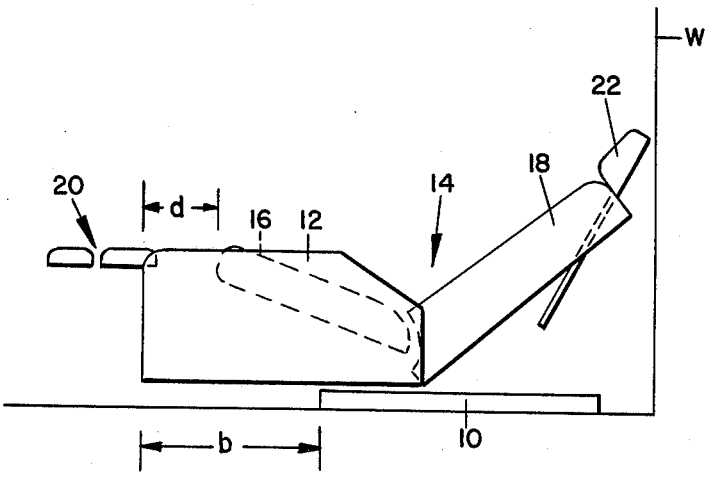

Referring first to FIGS. 1 – 3, a chair of the invention includes a base 10, a chassis 12 mounting a body-support 14, comprising a seat 16 and backrest 18 which may be unitary as to each other or pivotal relative to each other, a legrest 20, which may be one or more parts, and a concealable headrest 22, the chair being shiftable between an upright sitting position and a plurality of reclining positions without contact with the room wall.

As chassis 12 moves in one direction relative to base 10, body-support 14 moves in counter direction relative to the chassis. As seen in FIGS. 2 and 3, the chassis has moved forwardly away from the wall the distance a in moving from upright to TV position and has moved forwardly a greater distance b in moving from TV to fully-reclined position. Concurrently with such forward movement of the chassis, the body-support has moved rearwardly relative to the chassis the distance *c* in moving from upright to TV position and has moved rearwardly a greater distance *d* in moving from from TV to fully-reclined position.

As body-support 14 is reclined, headrest 22 and legrest 20 are extended, chassis 12 moves linearly relative to base 10 away from wall W to provide the necessary clearance for the body-support and headrest as the chair elements move between the upright position of FIG. 1 and the partially reclined position of FIG. 2 and/or the fully reclined position of FIG. 3.

With reference now to FIGS. 4 – 7, a substantially horizontally-extending mounting bracket 24 is stationarily fixed at its forward end to a cross brace 26 and at its rearward end to a cross brace 28, the cross braces 26 and 28 being extendable transversely relative to and between the opposite sides of chassis 12.

Mounting bracket 24 extends in a front-to-rear dimension of the chair and a stop 110 extends outwardly therefrom adjacent its forward end and serves to limit downward movement of the reclining linkage to be described.

A seat bracket 32 is stationarily secured to the lower edge of seat 16.

A backrest link 34 is fixed to a side of backrest 18 and includes a lowermost forwardly-extending portion 36, the forward end of which is pivotally connected to seat bracket 32 as at 38.

The seat 16 and backrest 18 are pivotally supported for movement relative to chassis 12 by means of a first pivot link 40 pivotally connected at 42 at its upper end to backrest link 34, and thereby to backrest 18, and pivotally connected at 44 at its lower end to mounting bracket 24 and thereby to chassis 12.

Additionally, the seat and backrest are pivotally supported for movement relative to the supporting framework by means of second and third pivot links 46 and 48 respectively, as will appear.

Legrest 20 is positioned at the forward end of the chair and includes a major legrest portion 50 and a minor legrest portion 52 pivoted thereto adjacent its lower end.

The legrest, which could be of one-part construction in lieu of two-part, is mounted on the forward end of seat 16 for movements between a retracted position and an extended position, and a plurality of intermediate positions therebetween.

In the chair fully upright or sitting position, major legrest portion 50 is disposed substantially flush with the forwardly-facing vertical wall of seat 16, while cooperant minor legrest portion 52 extends rearwardly from the lower end of said major legrest portion so as to be hidden from view beneath the seat.

When major legrest portion 50 is elevated and advanced, cooperant minor legrest portion 52 is moved to a position forwardly thereof and in axial alignment therewith.

The legrest is suspended from seat 16 by a means inclusive of third pivot link 48, a first actuator link 54, and a second actuator link 56.

Third pivot link 48 is pivoted at 58 at its upper end to seat bracket 32 and is pivoted at 60 at its lower end to the forward end of a rise bar 62, to be described.

A legrest drive link 64 is pivoted at the pivot 60 at its rearward end to rise bar 62 and is pivoted at 66 at its opposite forward end to the approximate midsection of first actuator link 54.

First actuator link 54 is pivoted at 68 at its upper end to seat bracket 32 and at 70 at its lower end to the lower end of a third actuator link 72.

Second actuator link 56 is pivoted at 74 at its upper end to seat bracket 32, at 76 below its midsection to third actuator link 72 and at 78 at its lower end to the lowermost extremity of a first lifter link 80.

First lifter link 80 is pivoted at 82 at its forward end to a major legrest plate 84 which functions as a support for major legrest portion 50.

First lifter link 80 is pivoted at 86, upwardly of its midsection, to a second lifter link 88.

Second lifter link 88 is pivoted at 90 at its upper end to the upper end of third actuator link 72 and is pivoted at 92 at its lower end to the lower end of a first control link 94.

First control link 94 is pivoted at 96 at its forward end to a minor legrest plate 98 which functions as a support for minor legrest portion 52.

Major and minor legrest plates, 84 and 98 respectively, are articulately interlinked by a pivotal connection 100.

A second control link 102, extending between major legrest plate 84 and primary control link 94, is pivoted at 104 at one of its ends to the major legrest plate and is pivoted at 106, at its opposite end to the primary control link.

In the upright position of the chair with the legrest retracted, the forward edge of third actuator link 72 abuts the rearward edge of first lifter link 80 to limit the range of rearward motion of the legrest, the rearward edge of the first lifter link being concaved, so as nestably to receive the forward edge of the third actuator link therein.

In the reclining positions of the chair, with the legrest extended, the forward edge of first actuator link 54 is receivable in a notch on the rearward edge of second actuator link 56 to limit the range of extension of the legrest.

Rise bar 62 operatively connects the legrest linkage means to the seat 16 by means of third pivot link 48 which is pivoted at 60 to a forward portion of the rise bar.

Rise bar 62 rotates about a pivot 108 at its rearward portion relative to mounting bracket 24 on reclining movement between intermediate and full-reclined position and return.

The lower edge of the rise bar is adapted to abut stop 110 on mounting bracket 24 so as to preclude downward movement of the rise bar beyond the desired limits.

A friction plate 112 is pivoted at 114 to rise bar 62 and is provided with an arcuate forward edge which terminates adjacent its upper extremity in an offset lip or flange 116 which functions as a stop in the fully-reclined position of the chair upon engagement in a notch 118 provided in the upper edge of rise bar 62.

A portion of rise bar 62 adjacent the arcuate edge of friction plate 112 is deformed to provide an offset friction finger 120, the friction finger and rise bar being cooperant to allow insertion of a portion of friction plate 112 therebetween, with one planar face of the friction plate being flush with the inner planar face of rise bar 62, and with the other planar face of the friction plate being flush with the inner planar face of friction finger 120.

Tension means 122 is provided wherefore friction finger 120 is drawn inwardly to increase the frictional engagement between friction plate 112 and rise bar 62, and conversely, the frictional engagement between friction plate 112 and rise bar 62 may be decreased, the whole functioning as an adjustable braking system whereby the force or weight required to move both the seat and backrest to one of a plurality of reclining positions may be varied, in accordance with the dictates of the chair occupant.

A lower portion of friction plate 112 forms a link 124 which is pivoted at 126 to the lower end of second pivot link 46, with the second pivot link in turn being pivoted at 128 at its upper end to seat bracket 32.

A seat control link 130 is pivoted at 132 at its lower end to mounting bracket 24 and at 134 at its upper end to friction plate 112. Seat control link 130 functions to control elevation of the seat during angularization of the body-support between the intermediate and the fully-reclined chair positions.

A tension spring 136 is fixed at one end to seat bracket 32 and its other end to mounting bracket 24 to assist in returning the chair to an upright position.

Headrest 22 is operatively connected by means now to be described to the body-support, to the chassis and to the legrest for movement between a retracted or concealed position when the chair is upright and an exposed position overlying the backrest 18 when the chair is reclined, the headrest and legrest reaching their respective extended positions simultaneously.

Headrest 22 is fixed to the upper ends of a pair of bars 138, only one of which is shown in the drawings, each of which is fixed at its lower end to a support plate 140. In lieu of bars 138, a single support member or panel could be utilized.

Figure 4:
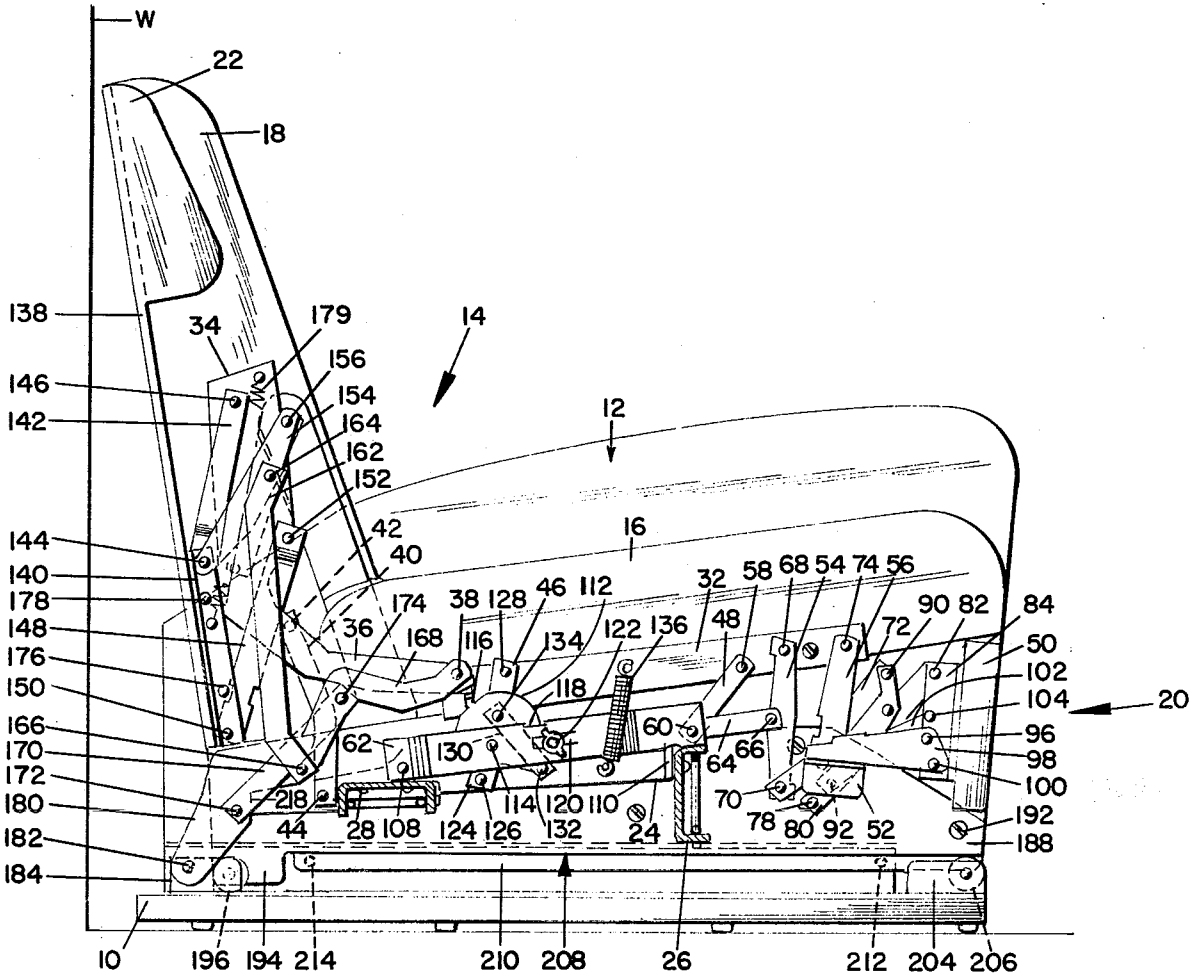
FIG. 4 is a fragmentary view, in longitudinal section, of the chair of FIGS. 1 – 3 in upright, sitting position.
Figure 5:
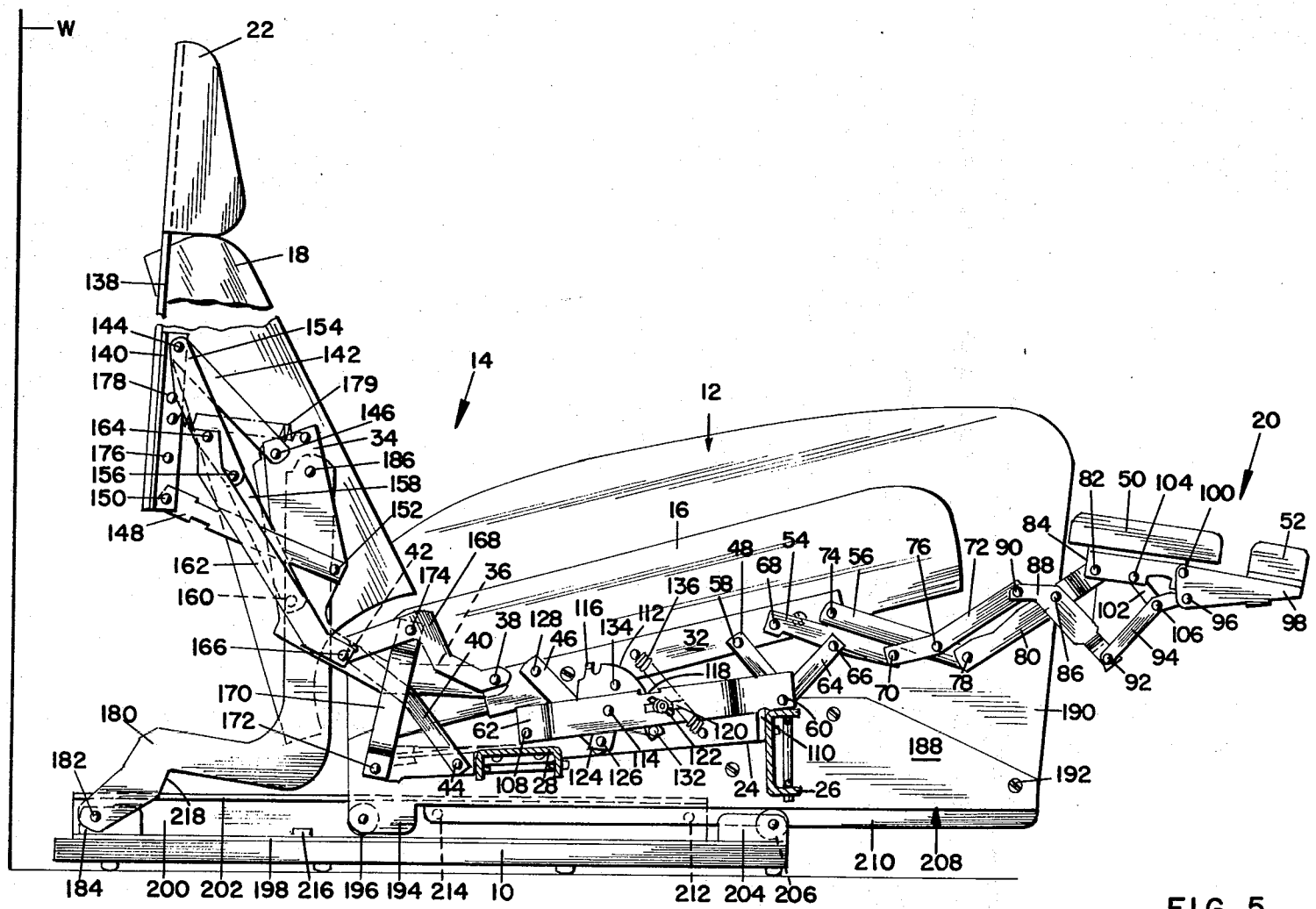
FIG. 5 is a view, similar to FIG. 4, showing the chair in partially-reclined or TV position.
Figure 6:
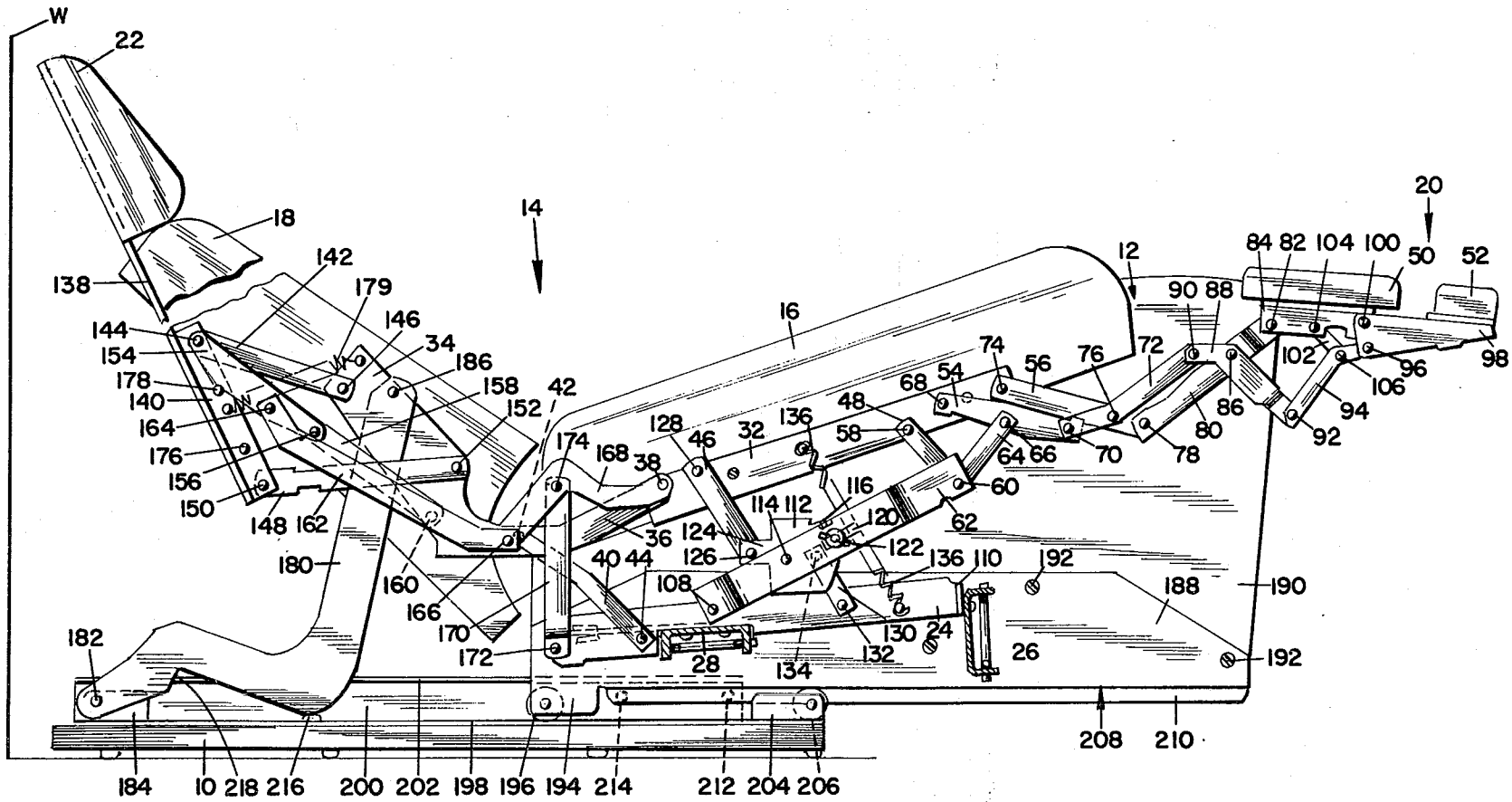
FIG. 6 is a view, similar to FIG. 4, showing the chair in fully-reclined position.
Figure 7:
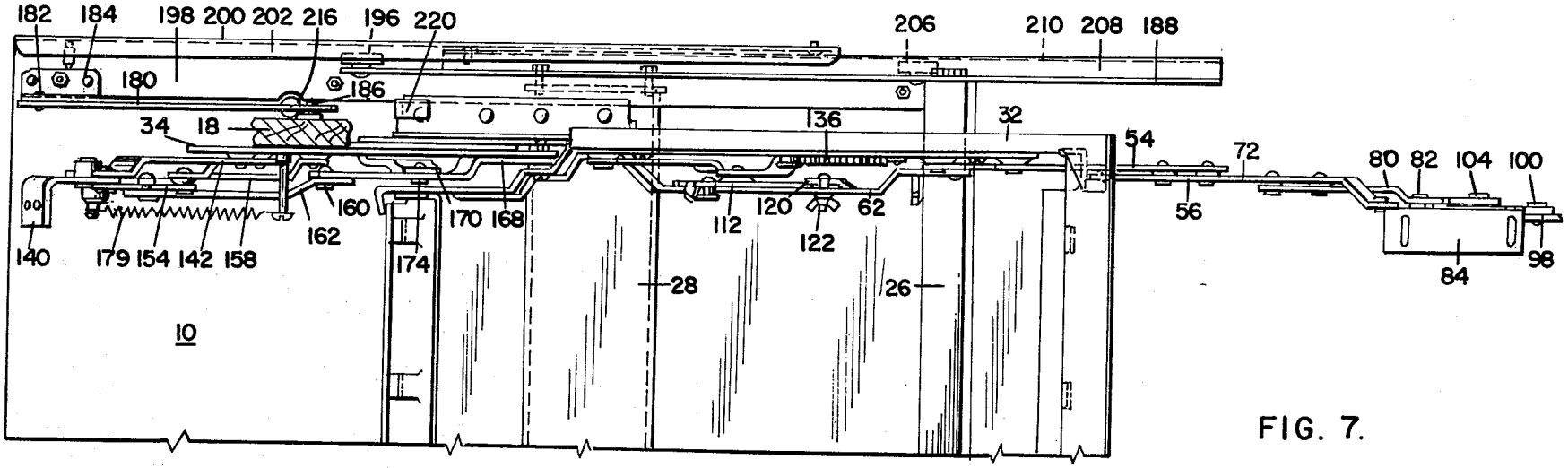
FIG. 7 is a view, in top plan, of the chair of FIG. 6, with parts omitted for clarity.

The headrest is movable between a retracted or concealed position, wherein it is disposed within the backrest when the chair is in an upright position as in FIGS. 1 and 4, and an extended or exposed position, wherein it is disposed above the upper end of the backrest, when the chair is reclined, as in FIGS. 2, 3, 5 and 6.

A primary pivot link 142 is pivoted at one end at 144 to the upper end of support plate 140 and at its opposite end at 146 to the upper end of backrest link 34.

A secondary pivot link 148 is pivoted at one end at 150 to the lower end of support plate 140 and at its opposite end at 152 to the approximate midsection of backrest link 34.

A primary toggle link 154 is pivoted at one end to support plate 140 at the pivot 144 and is pivoted at its opposite end at 156 to one end of a second toggle link 158 which is pivoted at its lower end at 160 to backrest link 34.

A connecting link 162 is pivoted at one end at 164 to the approximate midsection of primary toggle link 154 and is pivoted at its opposite end at 166 to one end of a seat link 168 which is pivoted at its opposite forward end to seat plate 32 at the pivot 38.

A secondary drive link 170 is pivoted at one end at 172 to mounting bracket 24 and at its opposite end at 174 to the approximate midsection of seat link 168.

A first stop 176 on support plate 140 is engageable by an edge of secondary pivot link 148 to preclude retraction of the headrest 22 beyond a desired limit when the chair is upright.

A second stop 178 on support plate 140 is engageable by an edge of primary toggle link 154 to preclude overtravel of said primary toggle link and secondary toggle link 158, whereby those links assume a toggled or locked position to prevent movement of the headrest 22 beyond a desired limit when the chair reaches the reclined position.

A tension spring 179 extends between support plate 140 and backrest link 34 for insuring smooth movement of the headrest.

When the chair is in fully upright position, legrest unit 20 is retracted, with major legrest portion 50 positioned substantially flush with the forward end of seat 16, and with minor legrest portion 52 disposed rearwardly thereof beneath the seat and headrest 22 is retracted within backrest 18. In such chair position, rise bar 62 is in a generally-horizontal position, and rests on stop 110 with friction finger 120 and tension means 122 being disposed adjacent the lower end of the arcuate edge of friction plate 112.

To reach the intermediate reclining position from upright position, the chair occupant may bring rearward pressure to bear upon backrest 18, causing the seat and backrest structures to move in substantially rearward directions by the coordinated swinging movements of first pivot link 40 and second pivot link 46 and third pivot link 48, and legrest drive link 64 each upon its respective pivot points.

By so mounting the seat and backrest, the body-support is movable from the upright or sitting position to intermediate and fully-reclined positions and/or to any position therebetween and, of course, also reversely.

In the course of movement from upright position to a reclining position wherein headrest 22 is extended, seat link 168 is rotated in a clockwise direction, as viewed in the drawings, by first drive link 170, the seat link in turn urging primary toggle link 154 to pivot in a clockwise direction, thereby to urge the support plate 140 to move rearwardly and upwardly, swinging by means of pivot links 142 and 148 relative to backrest link 34.

Such swinging movement of support plate 140 continues as the chair is reclined to move headrest 22 upwardly to a desired position wherein, upon reaching the intermediate reclining position, the lower edge of the headrest is disposed immediately above the upper edge of backrest 18.

Upon attainment of the intermediate reclining position, second stop 178 on support plate 140 is engageable by an edge of primary toggle link 154 to preclude overtravel of the primary toggle link and secondary toggle link 158 whereby those links assume a toggled or locked position to prevent movement of headrest 22 beyond a desired limit when the chair reaches reclined position.

Upon movement of the chair from the intermediate position to the fully reclined position, the headrest remains in an extended position upwardly of the backrest as a locked or toggled-in-place unit, simply swinging with the backrest as the body-supporting unit is reclined, being so held by toggle links 154 and 158, said toggle being limited by stop 178.

Similarly, upon movement of the chair from the fully reclined position to the intermediate reclined position the headrest remains extended, again as a locked, toggled-in-place unit by the toggle links 154 and 158, said toggle being limited by stop 178.

Upon movement of the chair from the intermediate position to the upright position, the support plate 140 is swung downwardly in the reverse direction to return the headrest to a retracted position within the backrest.

It is to be understood that while I have shown the headrest and its actuating means as operating in conjunction with a specific linkage for effecting reclination of the chair and extension of the legrest, any suitable mechanism for effecting such reclination and legrest extension may be substituted.

The means mounting the chassis and body-support for linear travel relative to the base will now be described.

A main drive link 180 is pivoted at one end at 182 to a first bracket 184 fixed to base 10 adjacent the rearward end of the latter and is pivoted at its other end at 186 to backrest 18.

A chassis plate 188 is fixed to a side wall 190 of chassis 12 as by screws 192 and has a depending extension 194 adjacent its rearward end, which extension carries a first roller 196 rotatably mounted thereon, the roller being in rolling contact with a plate 198 fixed to the upper surface of base 10.

Plate 198 has an upright side wall 200 terminating at its upper end in an in-turned upper wall or flange 202.

Plate 198 is additionally offset adjacent its forward end to provide an upright wall 204 which is spaced inwardly from wall 200. Wall 204 carries a second roller 206 rotatably mounted on its inwardly-facing face, which roller is in rolling contact with a horizontal wall 208 thereabove provided by offsetting the lower edge of chassis plate 188, said lower edge depending below the plane of the lower edge of the chassis.

Horizontal wall 208 is bent downwardly along its outer edge to form a vertically-depending wall 210 against the outer face of which a first chafing button 212 on wall 200 of plate 198 may bear.

A second chafing button 214 is provided on wall 210 of chassis plate 188 for bearing against the inner face of wall 200 of plate 198.

The chafing buttons insure against lateral shifting as the chassis rolls linearly relative to the base.

Figure 9:
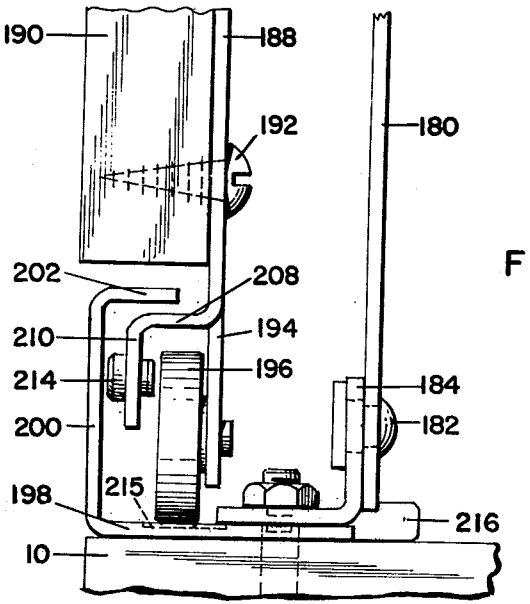
FIG. 9 is a view, in rear elevation, of a portion of the linear movement mechanism, with parts omitted for clarity.
Figure 8:
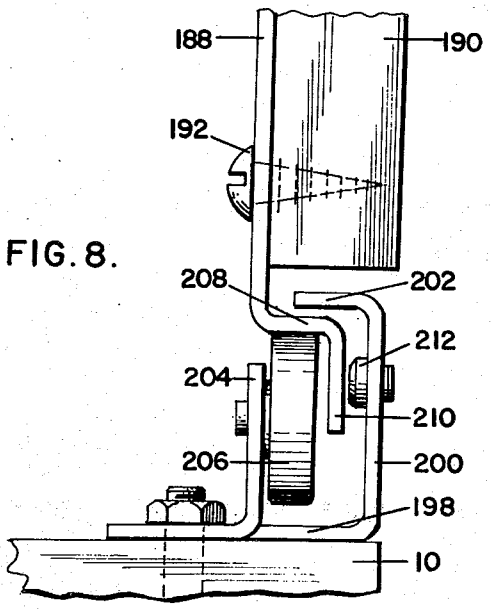
FIG. 8 is a view, in front elevation, of a portion of the linear movement mechanism, with parts omitted for clarity.

As seen in FIG. 9, a depression 215 is provided in the upper face of plate 198 for the reception of roller 196 therein, this depression serving to act as a restraint against sudden and unwanted linear movement of the chassis.

A first stop 216 on base 10 is adapted to be contacted by a lower edge of main drive link 180 in the fully-reclined position of the chair to preclude further linear travel of the chassis relative to the base.

A stop surface 218 on drive link 180 is adapted to contact a stop 220 (see FIG. 7), on the chassis in the upright sitting position of the chair to preclude further linear travel of the chassis relative to the base.

Figure 10:
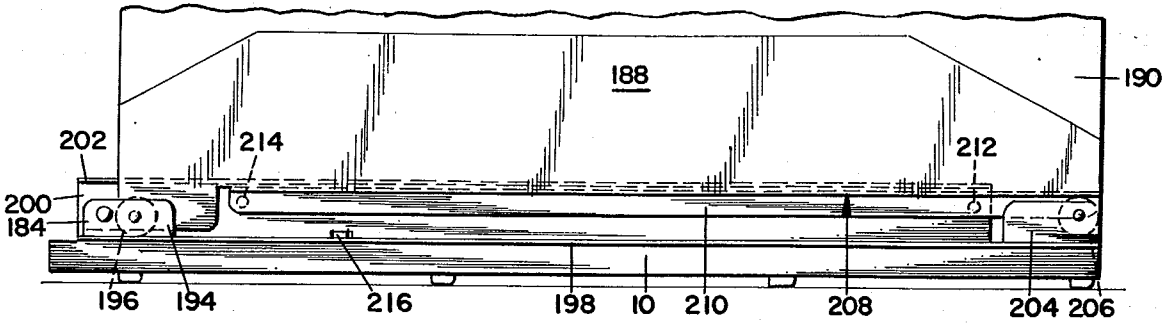
FIGS. 10 – 12 are views, in side elevation, of a portion of the linear movement mechanism, showing the relative positions of the mechanism in the chair upright, partially-reclined and fully-reclined positions respectively.
Figure 11:
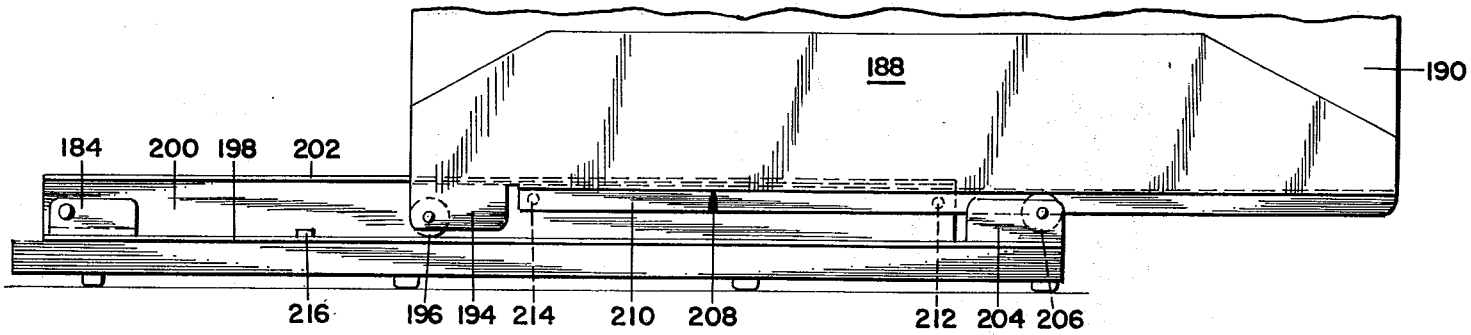
Figure 12:
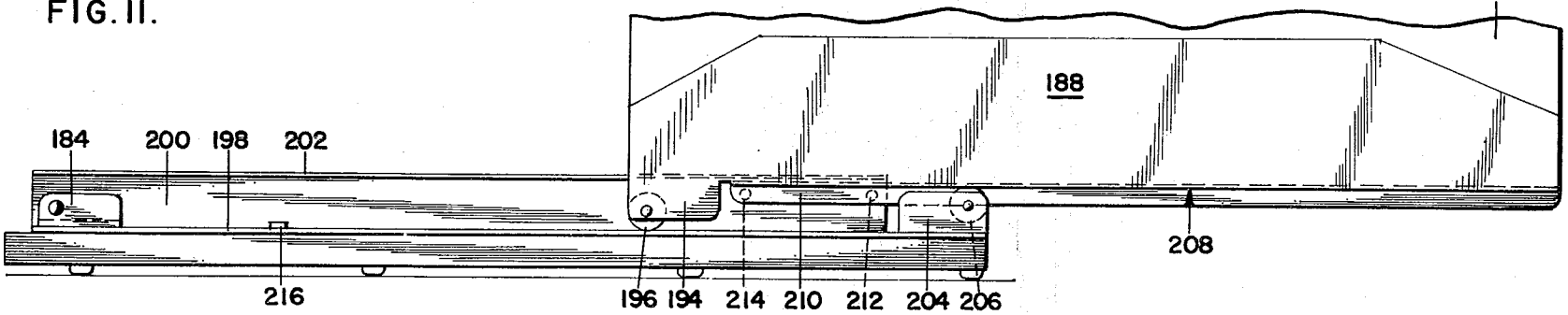

Travel of the chassis relative to the base is best seen in FIGS. 10 – 12, wherein movement has been shown from the upright position of FIG. 10, to the intermediate reclined position of FIG. 11, to the fully-reclined position of FIG. 12, smooth rolling movement being insured by the rollers 196 and 206 and the chafing buttons 212 and 214, with the main drive link 180 driving the chassis forwardly while also initiating reclination of the body-support, and extension of the headrest and legrest.

It will also be noted that as the chassis moves linearly away from the wall, the body-supporting unit is moving in a counter-direction toward the wall, as previously described with reference to FIGS. 1 – 3.

I claim:

1. A reclining chair characterized by being positionable in close adjacency to and free of attachment to a room wall or article of furniture when disposed in upright sitting mode and to be shiftable into any reclining mode free of any physical contact with that room wall or article of furniture the reclining chair kinematically constituting a single mechanism consisting of:

a base, a chassis supported relative to the base, a body-support including a seat and a back separable from the seat, a headrest, a legrest, means for mounting the body-support relative to the chassis for movements between upright sitting and reclining modes, means for mounting the chassis relative to the base in a linear movement relative to the base as the body-support is concurrently moved, means for mounting the headrest and legrest relative to the body-support for movement between retracted and extended positions as the body-support is concurrently moved, and means operatively-connecting the body-support and base for moving the chassis forwardly and progressively away from the wall and the body-support relative to the chassis and the wall as transition is made from upright sitting position toward a reclining position and for moving the chassis rearwardly and progressively toward the wall and the body-support relative to the chassis and the wall as transition is made from a reclining position toward upright sitting position.

2. An occupant-operated living room type reclining chair positionable anywhere on a floor of a room free of attachment to the floor and in close adjacency to and forwardly of an object when in upright sitting position and yet so constructed as to allow ready assumption of any reclined position free of physical contact with the same object and comprising:

a base resting on the floor, free of permanent attachment to the floor, a chassis supported relative to the base, a body-supporting subassembly including a seat and backrest, a leg-supporting subassembly, a headrest subassembly, and linkage means operatively-interconnecting the body-supporting subassembly and leg-supporting subassembly and headrest and chassis and base for, first, concurrently moving:

a. the body-supporting subassembly rearwardly relative to the chassis, b. the leg-supporting subassembly and headrest subassembly between retracted and extended positions, and c. the chassis relative to the base and progressively forwardly away from the object, as transition is made from upright sitting position to a position of reclination by the occupant leaning backwardly against the backrest and exerting a forwardly-pushing force against the chassis, and for, second, concurrently moving:

a. the body-supporting subassembly forwardly relative to the chassis, b. the leg-supporting subassembly and headrest subassembly between extended and retracted positions, and c. the chassis relative to the base and progressively rearwardly toward the object, as transition is made from a position of reclination to upright sitting position by the occupant leaning forwardly away from the backrest and exerting a downwardly-pushing force against the leg-supporting subassembly, with any linear movement of the body-supporting subassembly relative to the base being in substantially inverse ratio to any linear movement of the chassis relative to the base.

3. A reclining chair movable by the occupant between upright sitting and intermediate-television and fully-reclined positions and positionable anywhere on a floor of a room and free of attachment to the floor and in close adjacency to a wall when in upright sitting position and yet so structured as to allow ready assumption of intermediate-television and fully-reclined positions free of contact with the wall comprising: a base, a chassis, a body-supporting subassembly including a seat and backrest, a leg-supporting subassembly, a headrest subassembly, linkage means for effecting movement of the body-supporting subassembly between upright and intermediate and reclined positions concurrently with movement of the leg-supporting subassembly and headrest sub-assembly between retracted and extended positions respectively and for effecting movement of both the chassis and body-supporting subassembly relative to the base in one direction responsively to and simultaneously with movement of the body-supporting subassembly relative to the chassis in counter direction.

4. A reclining chair adapted to be movable on a floor of a room and into close adjacency to and forwardly of an object when in upright sitting position and yet so structured as to allow ready assumption of a reclining position free of physical contact with the same object, the reclining chair comprising: a base, a chassis supported relative to the base, a body-support including a seat and back and legrest and headrest having pivotal relationships as to each other, control means for controlling the pivotal movements of the back relative to the seat of the body-support, and linkage means operatively-interconnecting the body-support and chassis and base and legrest and headrest for concurrently moving the chassis relative to the base and forwardly and progressively away from the object and the body-support rearwardly relative to the chassis and the legrest and headrest from retracted to an extended position as transition is made from upright sitting to reclination positions and for concurrently moving the chassis relative to the base rearwardly and progressively toward the object and the body-support forwardly relative to the chassis and the legrest and headrest from an extended to retracted position as transition is made from reclination to upright sitting positions.

5. A reclining chair adapted to be positioned on a floor more particularly in close adjacency to and forwardly of an object when in upright sitting position and yet so structured as to allow ready assumption of a reclining position without physical contact with the same object, the reclining chair comprising:

a base, a chassis supported relative to the base, a seat and a back having a pivotal relationship as to each other, a legrest, a headrest, roller means disposed between and fixed to one of the chassis and base, control means for controlling the pivotal movements of the back relative to the seat, and linkage means operatively-interconnecting the seat and back and legrest and headrest and chassis and base for concurrently propelling the chassis relative to the base and forwardly and progressively away from the object and the seat rearwardly relative to the chassis and the legrest and headrest from retracted to an extended position as transition is made from upright sitting position to a position of reclination responsively to an impelling force generated by the occupant upon the chassis in one direction with a resultant reaction of the seat relative to the chassis in a counter direction.

* * * * *

UNITED STATES PATENT OFFICE

CERTIFICATE OF CORRECTION

PATENT NO. : 3,958,827

DATED : May 25, 1976

INVENTOR(S) : Frank M. Ré

It is certified that error appears in the above-identified patent and that said Letters Patent are hereby corrected as shown below:

Title page, at item [63], change "abandoned"

to -- now patent No. 3,874,724 --

Column 1 at lines 4 and 5, change "abandoned"

to -- patent No. 3,874,724 --

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*